US005738185A

United States Patent [19]

Sears

[11] Patent Number: 5,738,185

[45] Date of Patent: Apr. 14, 1998

[54] PORTABLE SWIVELING LIFT DEVICE

[76] Inventor: Michael R. Sears, 244 Canal La., Winnfield, La. 71483

[21] Appl. No.: 715,015

[22] Filed: Sep. 17, 1996

Related U.S. Application Data

[63] Continuation-in-part of Ser. No. 389,245, Feb. 16, 1995, abandoned.

[51] Int. Cl.[6] ..... E04G 1/08

[52] U.S. Cl. ..... 182/102; 182/118; 182/129

[58] Field of Search ..... 182/102, 101, 182/129, 118

[56] References Cited

U.S. PATENT DOCUMENTS

| | | | |
|---|---|---|---|
| 231,567 | 8/1880 | Harris | 182/102 X |
| 369,148 | 8/1887 | Wright | 182/102 X |
| 3,189,123 | 6/1965 | Bond | 182/129 X |
| 4,274,508 | 6/1981 | Hughes et al. | 182/129 X |
| 4,690,248 | 9/1987 | Killeen | 182/118 |
| 5,139,108 | 8/1992 | Pate | 182/129 |
| 5,242,031 | 9/1993 | Ashley | 182/129 X |

*Primary Examiner*—Alvin C. Chin-Shue
*Assistant Examiner*—Long Dinh Phan
*Attorney, Agent, or Firm*—Harrison & Egbert

[57] ABSTRACT

A lifting apparatus having a frame with a first bracing member and a second bracing member pivotally connected together with a ladder receptacle means affixed to an end of the second bracing member opposite the pivotal connection, and a pulley affixed to the frame so as to receive a cable therein such that a portion of the cable extends vertically downwardly between the first and second bracing member. At least one wheel is connected to an end of the first bracing member opposite the pivotal connection with the second bracing member so as to allow and end of the first bracing member to be moved toward and away from the second bracing member. A winch is attached to the first bracing member and a cable extends outwardly from the winch and over the pulley. A stop plate is connected to the frame at a location below the pivotal connection so as to limit an angle of pivotal movement of the first bracing member with respect to the second bracing member. The ladder sheath is pivotally connected to an end of the second bracing member.

12 Claims, 7 Drawing Sheets

PORTABLE SWIVELING LIFT DEVICE

RELATED APPLICATION

The present application is a continuation-in-part of U.S. patent application Ser. No. 08/389,245, filed on Feb. 16, 1995, abandoned, and entitled "PORTABLE SWIVELING LIFT DEVICE", presently pending.

TECHNICAL FIELD

This invention relates to portable lift devices, specifically, when used to lift objects onto or off of structures or suspend or support objects beside structures and when used in conjunction with one or more ladders or ladder-like devices.

BACKGROUND ART

Heretofore, various portable lift devices have been used in conjunction with ladders or ladder-like devices to lift objects onto or off of structures or to suspend materials or personnel next to structures. U.S. Pat. No. 4,690,248 issued to Killeen, is an example of a lifting device, used in conjunction with a ladder, which includes a collapsible frame similar to a ladder. It is defined as an inverted "U" shaped ladder-like frame which rigidly attaches to a ladder. It does so in a time consuming method. It is also described as an apparatus to transport loads. This device does not allow for swiveling when connected to a ladder but is rigidly connected to a ladder. Also this device requires a worker or workers, at some point, to lift close to half the weight of the object or load while simultaneously telescoping two legs onto a structure as the load is manipulated. This can be unsafe and inefficient, if not timed perfectly. This also limits the weight which can be lifted. If such weight is too great, this can strain or injure workers.

U.S. Pat. No. 2,798,574, issued to R. D. Wardell, discloses a scaffold with a. hoist structure mounted, having a pulley cable and hoist cage that can be raised or lowered to the level of the scaffold.

U.S. Pat. No. 4,183,423, issued to J. P. Lewis discloses a ladder hoist in which the hoisting mechanism is provided as a part of the ladder. This patent further discloses a cable on a winch which runs over a pulley on the upper section of the ladder and is connected to a carriage having wheels running on the channeled sides of the ladder.

U.S. Pat. No. 3,722,621, issued to M. L. Jones discloses a ladder platform having a horizontal telescopic platform surface mounted on the ladder supporting members located at each end. The ladder support members are extendable so that the platform may be raised. The supports are hinged and attached to the platform member so that the apparatus may be collapsed for storage or transport.

U.S. Pat. No. 2,706,057, issued to H. F. Belding, discloses a structure having a hoist element comprised of a cable, pulley, and reels mounted on one of the legs.

U.S. Pat. No. 3,093,209, issued to L. Nagy, discloses a combination step ladder and scaffold which teaches the use of a step ladder element, prop element, and platform element which swivels with respect to each other to collapse the apparatus.

These and other known lifting devices are useful but none provide for simultaneous swiveling with a ladder or the like as load is manipulated on the device between a ladder and a structure. None provide for potential unlimited multiple attachment of like devices to each other to form one stable lifting device which swivels together to lift extremely heavy or long loads. None provide, in conjunction with a ladder or the like and a structure, the ability, whether in singular or multiple application, to lift close to 100% of the vertical weight of the load during the entire process. None provide that during this entire process no adjustment, manipulation, or changing of the parts of the apparatus are necessary, except to roll the unit and load to or from structure. The "entire process" refers to lifting or lowering a load from the top of a structure, including the pushing out of the unit or pulling in of the unit with attached load to or from the structure.

In conjunction with a ladder or the like and a structure, none provide for a general triangular shape which is structurally one of the strongest, most rigid configurations when used to support or lift weight. This shape eliminates the need for material which increases weight and decreases ease of portability, while not sacrificing strength. None provide for such a light weight lifting device which can easily be transported to a roof top or other structure while having the option to keep the actual lifting power device (winch, etc.) close to ground level, keeping the swiveling lift device even lighter.

It is an object of the present invention to provide a stronger, generally triangular shaped device for lifting or suspending loads with or without a winch type mechanism attached.

It is another object of the present invention to provide a quick and easy attachment of the lift device to a ladder or the like using an adjustable sheath type arrangement that locks or secures onto any ladder without any modification to the ladder.

It is another object of the present invention to provide a upon or within the sheath device or brace legs a means for the frame of the lift device to swivel or pivot, thereby simplifying the manipulation of loads into and away from a structure.

It is another object of the present invention to provide a device that will bear nearly 100% of the vertical weight of the load being handled without a worker or workers having to lift any of the load, either while lifting or lowering objects or setting or taking objects off of a structure to a higher or lower level or suspending objects beside structures.

It is another object of the present invention to provide a for a much less expensive, lighter, more portable, more compact and safer device for lifting heavy or large loads onto a structure.

It is another object of the present invention to provide for a lifting device that can easily be transported, set up quickly, and operated by a single worker.

It is a further object of the present invention to provide for a lifting device which is easier and less expensive to manufacture.

It is a further object of the present invention to construct a stronger, lighter unit that is different from all previously known counterparts in the way it works to lift near 100% of the vertical load, swivels, and, in its general triangular configuration may be used in conjunction with a ladder and a structure.

It is still a further object of the present invention to provide a swiveling lift device which needs no adjustment or manipulation of its parts, other than rolling it or pushing it laterally and manipulating a load pulling apparatus.

It is still a further object of the present invention to provide a way for multiple connections of any number of similar units to each other to form one extremely heavy duty lifting mechanism.

It is still a further object of the present invention to provide for multiple connection in either direction or to either side of the swiveling lift device.

It is still another object of the present invention to provide convenience to companies where two work vehicles can each carry a singular unit for lifting lighter and smaller loads. When heavy or long and large loads need to be lifted onto a structure, two or more work vehicles with singular units can come together and Join their swiveling lift devices for multiple applications.

It is a further object of the present invention to save money and time as opposed to rental, waiting for, and coordination with a crane to lift heavy or large objects onto structures It is another object of the present invention to provide a more reliable, stable, and quality lifting device for less cost.

It is still another object of the present invention to provide a lifting device that has a long life.

It is a further object of the present invention to provide less product liability risk due to increased safety, simplicity, strength, and decreased weight.

It is another object of the present invention to provide the option of a winch, or other similar device, which may be attached on the unit or on a ladder, thus making the device still lighter and simpler.

It is still a further object of the present invention to provide, in the HVAC industry, with the advent of the new freon laws, an easy method to lift, not only heavy condensers and package units, but also the heavy recovery machines, recovery tanks, tools, etc. now needed to do this type work.

These and other objects and advantages of the present invention will become apparent from a reading of the attached specification and appended claims.

SUMMARY OF THE INVENTION

The present invention satisfies the aforementioned needs by providing a device of generally triangular configuration, which is foldable, lightweight, and portable, which may be used with a ladder or the like, which support elements communicate on one side with a ladder and on the other side with a structure. It satisfies the need to be pivotable or swiveling at the ladder and lift near 100% of the vertical weight during the entire process, without need for adjustment or manipulation of the parts. It also satisfies the need to provide for the multiple attachment of similar lifting devices, in order to lift heavier or larger loads.

The general triangular shape which is formed is pivotable at its pinnacle by providing, in this embodiment, a pipe or rod within a pipe with beams or channels welded or otherwise attached, with two main supports on the interior pipe or rod and the other two main supports attached to the exterior pipe or rod. All four supports are cross braced. These supports are braced on each side by a generally horizontal element which makes the lifting device rigid when unfolded and in the operable position. Two of these supports go to wheels or other attachments which communicate with the structure. The other two supports go to a mechanism that attaches to the upper portion of a ladder or the like. A pivoting or swiveling sheath-type apparatus is positioned on the ladder.

DETAILED DESCRIPTION OF THE INVENTION

Figure 1:
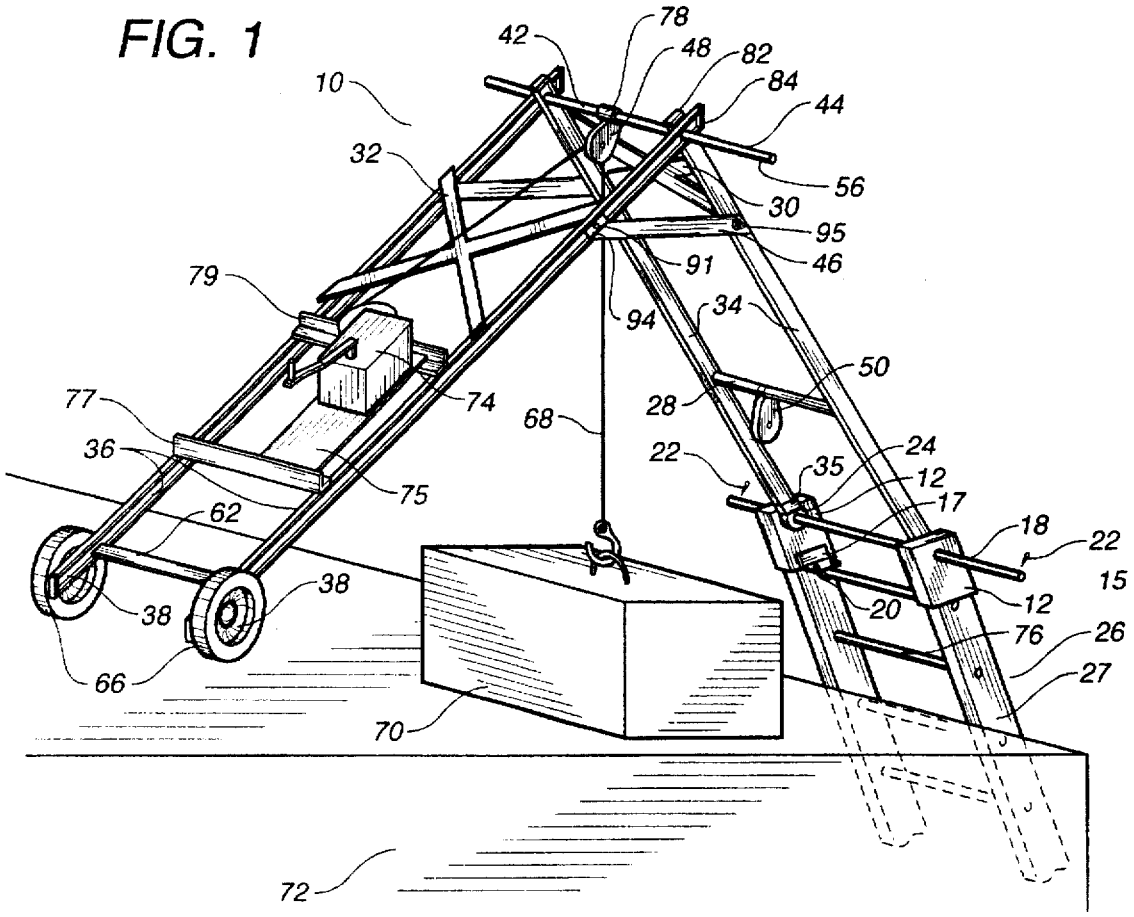
FIG. 1 is a perspective view of the preferred embodiment of the lifting device of the present invention.

As seen in FIG. 1, the main braces 34 extend obliquely upward from the sheath rod 18 to the top brace 42 onto which they are attached. The main braces 34 are not necessarily parallel with each other. The main braces 34 are further supported by the cross braces 30. The main braces 34 are joined transversely, near the sheath rod 18 end, by the pulley cross brace 28. Attached to the pulley cross brace 28 is the optional ladder pulley 50, through which the cable 68 passes if this option is used. The other possible configuration of the cable 68, and the preferred embodiment that is shown in the figures, is that the cable 68 passes from the load 70 up through the top pulley 48 and to the winch 74 attached to the winch plate 75 on the building structure 72 side and on the frame of the swiveling lift device 10. The winch plate 75 is attached to the bottom winch brace 77 and the top winch brace 79, which are both attached between the main braces 36.

Figure 7:
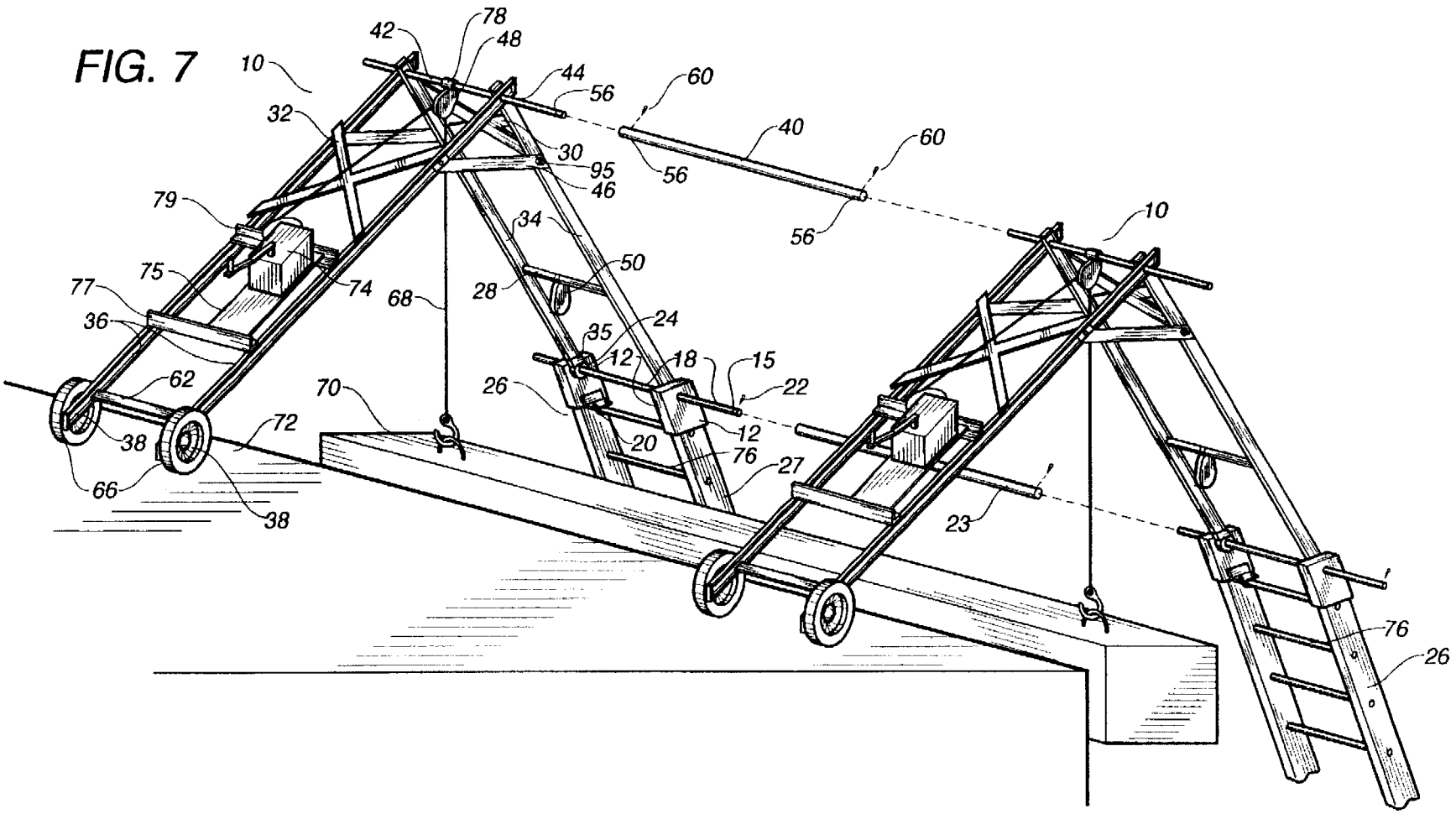
FIG. 7 is a perspective view of an alternative embodiment of the lifting device of the present invention as used in conjunction with an adjacent lifting device.

The main braces 36 go upward obliquely from attachment to the wheel axle 38 and are attached to the male top brace 44. The main B braces 36 are not necessarily parallel with each other. The main braces 36 are further supported by the cross braces 32. The wheel brace 62 joins the main braces 36 and provides extra rigidity to the frame. The wheels 66 are supported through the main braces 36. The female top brace 42 is penetrated by the male top brace 44. The set of main braces 36 are attached to the male top brace 44. The set of main braces 34 are attached to the female top brace 42. The stop plate 46 forms a triangle when connected to the braces 36 and the braces 34 and makes the frame a rigid structure. Each end of the male top brace 44 has pin holes 56 penetrating it, which can receive a connecting pin. This arrangement facilitates the attachment of another lifting device (as shown in FIG. 7). Also providing for this multiple attachment, on the distal end of the main braces 34 is attached, at point of swivel, the sheath rod 18, which penetrates the main rod pivot 24 and the adjustable ladder sheath 12. The rod pivot 24 has a main reinforcement 35 above it. This sheath 12 fits over the side rails 27 of the ladder 26. Attached to the bottom of the sheath 12 is the U-bolt bracket 17. The threaded ends of a U-bolt 20 fit through holes in the U-bolt bracket 17. The U-bolt 20 fits around the rails 27 rung 76. This secures the sheath 12 onto the rails 27. The sheath rod 18 extends beyond the ladder sheath 12 and has, close to each end, rod pin holes 15. These allow a rod connector to be pinned with rod pins, through pin holes, thereby joining another lift device 10 onto the ladder 26.

Figure 2:
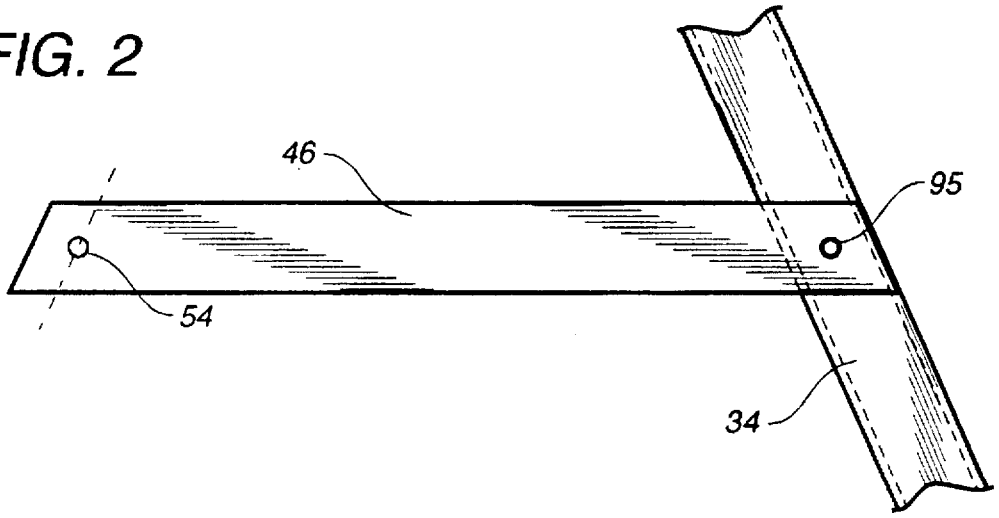
FIG. 2 is a side elevational view, in isolation, of the stop plate and stop bolt assembly of the present invention.
Figure 3:
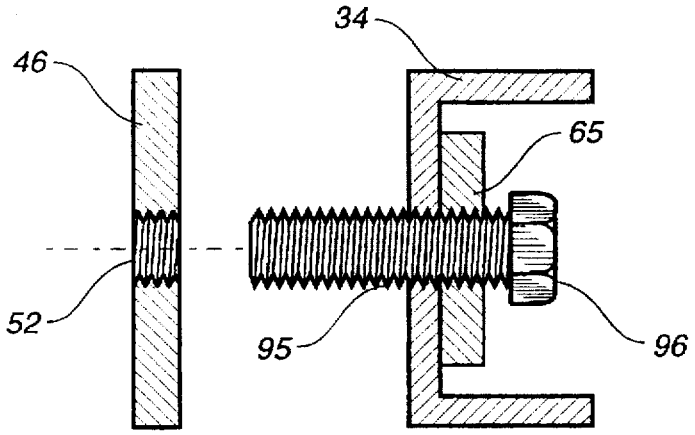
FIG. 3 is a side view of the stop plate and stop bolt assembly as used in the present invention.

As seen in FIG. 1, the winch assembly 74, the top pulley 48, and the top pulley bracket 78 are shown. The winch 74 is mounted between the braces 36 on a winch plate 75, attached to a bottom winch brace 77 and a top winch brace 79 which, each, attach to the braces 36. The cable 68 goes upward to the top pulley 48 that is mounted on a top pulley bracket 78. Shown also is reinforcements to the frame of the lift device 10. The top caps 82 are at the top terminal end of the braces 34. The top caps 84 are at the top terminal end of the braces 36. The stop plate 46 join the braces 36 and braces 34 to form a rigid structure. The stop plate bolt head 91 projects out past the bolt stop 94 through which the stop plate bolt 89 penetrates. This bolt head 91 is tightened or loosened when the unit 10 is unfolded and made ready for operation. The opposite side of the stop plate 46 has a swivel bolt 95 penetrating it. This is a point of support and stress and also a swiveling point of permanent attachment for the stop plate 46. FIGS. 2 and 3 explain and show these parts more thoroughly.

FIGS. 2 and 3 show the opposite side of the stop plate 46 where the swivel bolt hole 52 is permanently bonded to the swivel bolt 95. The stop plate 46 is able to rotate when the unit 10 is folded or unfolded. The swivel bolt head 96 keeps the swivel bolt 95 and the stop plate 46 in place and in permanent attachment. This assembly is located on the main braces 34 at point of juncture with the stop plate 46 and the swivel bolt 95. There is also a stop plate reinforcement 65 here, through which the bolt 95 penetrates.

Figure 4:
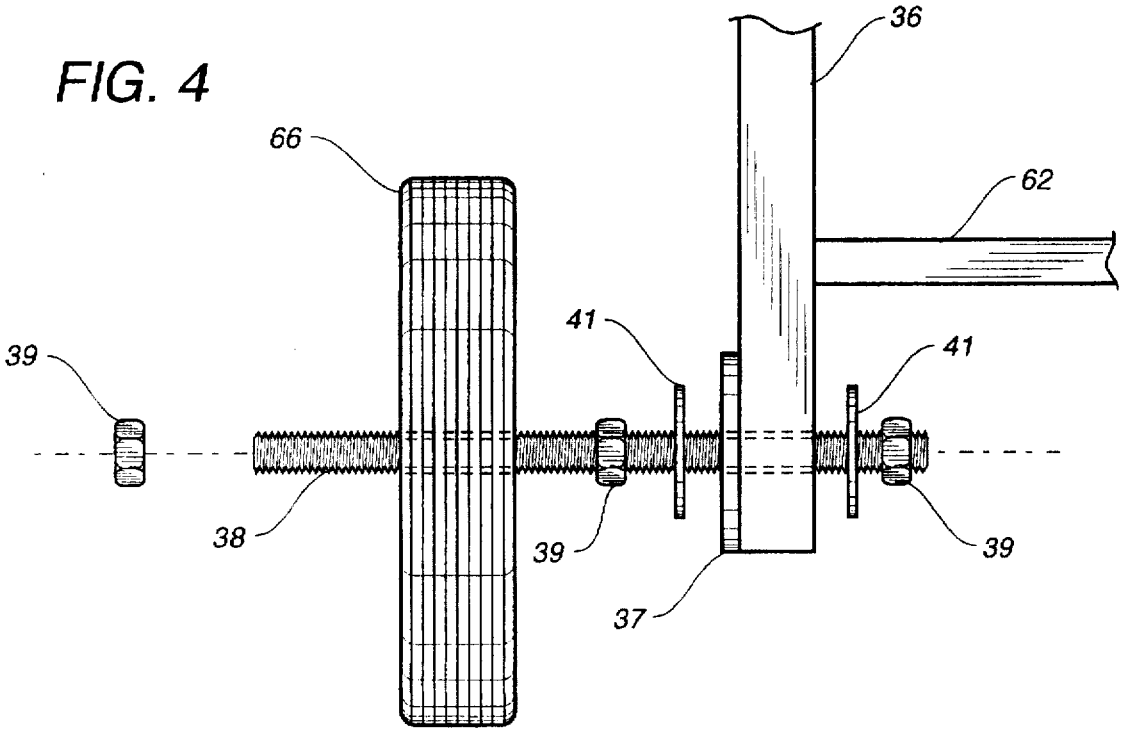
FIG. 4 is an isolated end view of the wheels, wheel axles and wheel braces as used in the present invention.

FIG. 4 shows the wheels 66, wheel axle 38, axle nuts 39, and wheel brace 62. These are all on the distal end of the main braces 36. The wheel brace 62 extends between the two main braces 36 and just above the wheel axles 38. The wheels 66 are on the axles 38 on the outside of braces 36 and are secured by axle nuts 39. The axle 38 penetrates the braces 36 and main reinforcements 37 and is secured by two axle bolts 39 that sandwich the reinforcements 37 and an axle washer 41 and the braces 36 and an axle washer 41. There are three axle bolts and two axle washers 41 on each side. One axle washer is between an axle bolt 39 and the brace 36. The other is between an axle bolt 39 and the reinforcement 37. The outside axle nut 39 holds on the wheel 66.

Figure 5:
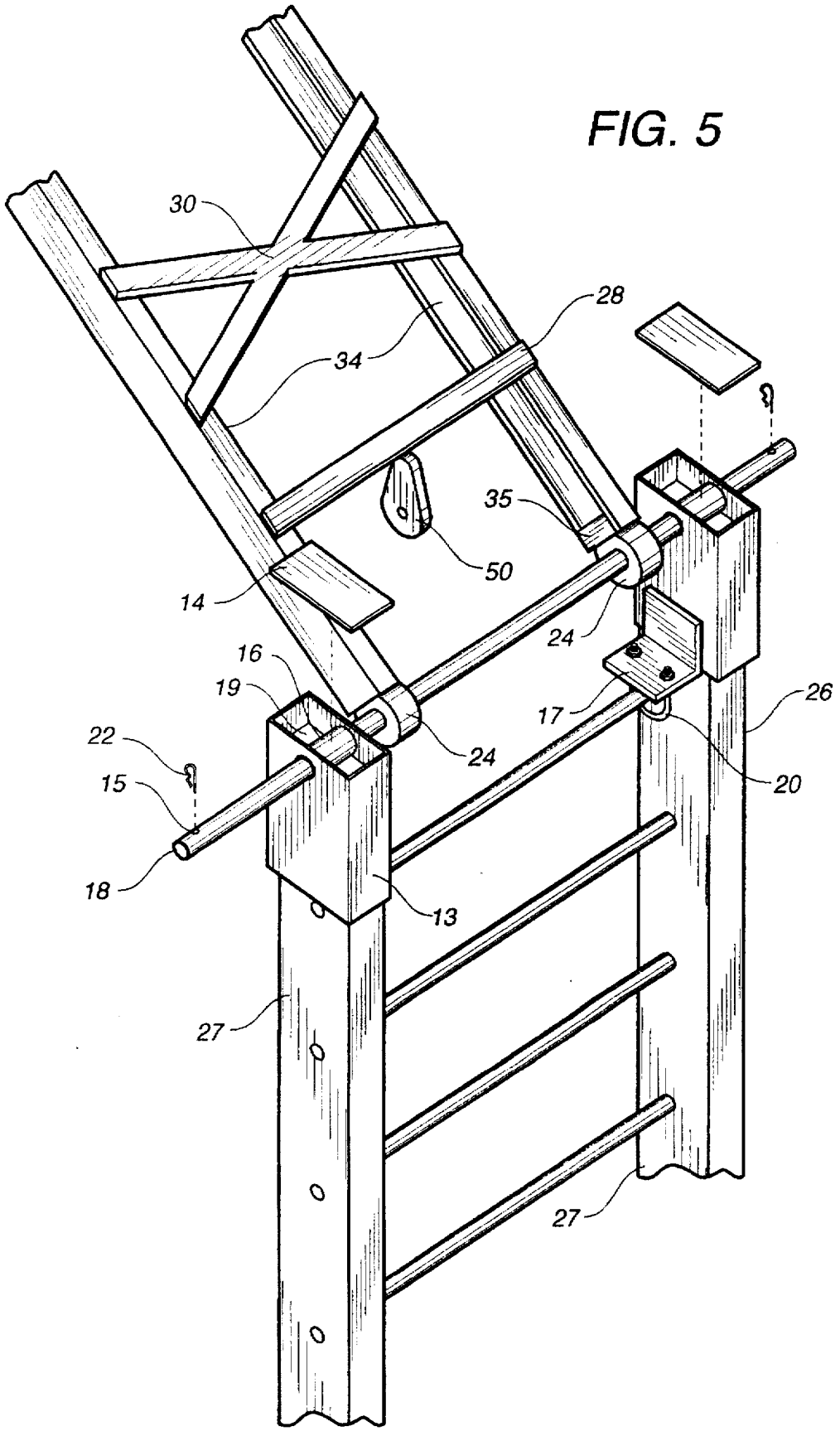
FIG. 5 is a perspective view, partially exploded, of the pivotting mechanism as used on the present invention.

FIG. 5 shows the adjustable ladder sheath 12 and pivoting mechanism. The adjustable ladder sheath 12 is comprised of a sheath tube 16 through which the sheath rod 18 goes. The sheath plate 19 rests underneath the sheath tube 16 and inside of the sheath body 13. This sheath plate 19 rests on top of ladder side rails 27 when sheath 12 is attached to ladder 26. The ladder rungs 76 do not touch the sheath 12. The ladder sheaths 12 may be permanently attached, if desired, to the ladder rungs 76. This is accomplished through the U-bolt bracket 17 which is on the inside of the ladder sheath 12. The U-bolt bracket 17 has standard holes drilled in it that will accommodate a standard U-bolt 20 enabling the sheaths 12 to be attached permanently to the rungs 76 of a particular ladder 26. The sheath cap 14 goes on top of the sheath 12.

The sheath rod 18 goes through the main rod pivot 24 and through the sheath tube 16 and is pinned with the rod pin 22. There is main reinforcement 35 above the rod pivot 24 on the main brace 34.

Figure 6:
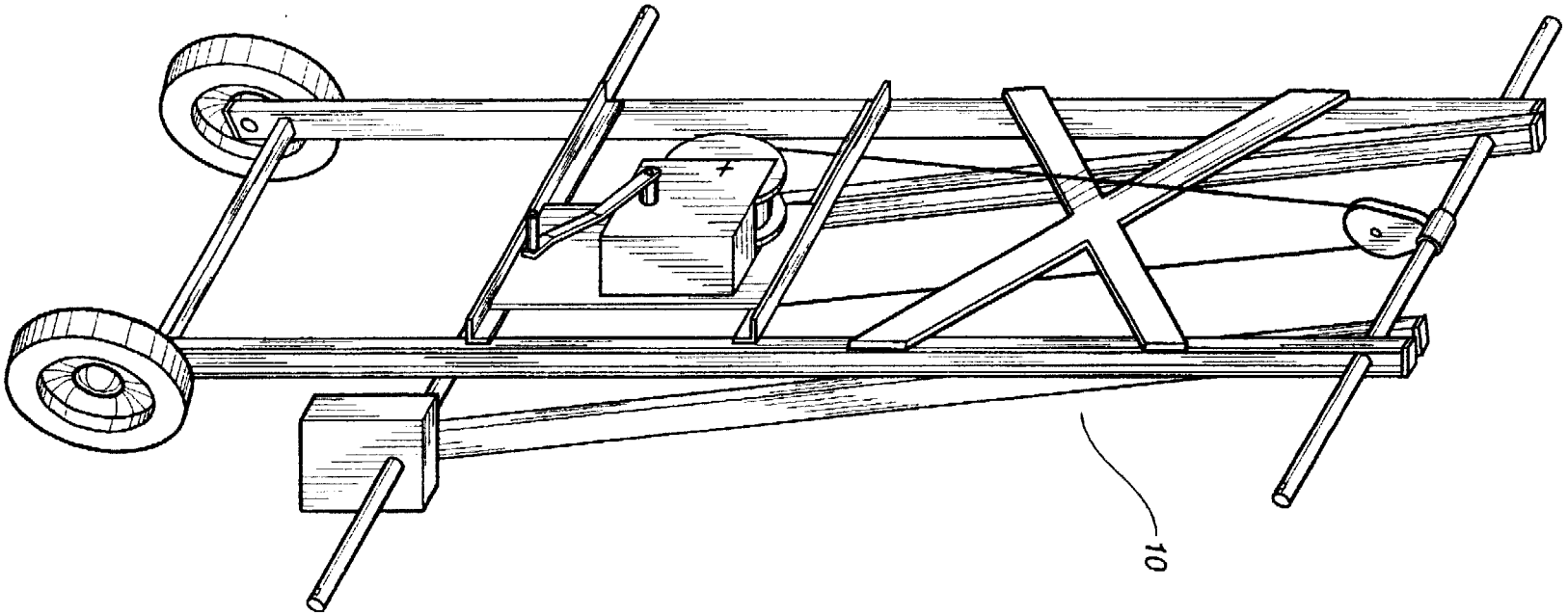
FIG. 6 shows a perspective view of the lifting device of the present invention in a folded condition for transport or storage.

FIG. 6 shows the swiveling device 10 in the folded position, ready for transport, storage, or carrying to a site.

FIG. 7 shows an embodiment of the invention in which two units are used on a structure 72, rolled out to the furthermost point, so as to lift a load 70. The exploded view of the multiple connecting brace 40 and the rod connector 23 shows how two swiveling devices 10 are connected for multiple application, yet it shows a view of the units 10 standing alone. The multiple connecting brace 40 or the rod connector 23 may be telescoping or otherwise adjustable. Any number of devices 10 may be connected to the male top brace 44 and sheath rod 18 on either side of the unit 10 via multiple connecting braces 40 and rod connectors 23. If an extremely tall object needs to be lifted, the top multiple connecting brace 40 may be left off with only the rod connector 23 in peace and the load 70 can be lifted between each lift device 10. Both the multiple connecting brace 40 and the rod connector 23 may be left off and a load lifted, if extreme care is taken to be stable and synchronous with all maneuvers. The actual weight on each unit 10, in dual multiple applications, should be centered under each unit 10 so that the cable 68 goes straight down.

Referring to FIGS. 1 and 7, the operation of the present invention is shown. The main braces 34 form the legs of the unit on the ladder 26 side. These braces 34 extend obliquely upward from the sheath rod 18 to the female top brace 42 onto which they are attached. In this embodiment, a metal channel is used with the flat side to the outside and connected to the female top brace 42 near each end. The main brace 34 is shorter than the main brace 36. The main braces 36 form the legs of the device 10 on the structure 72 side where the wheels 66 are attached onto the braces 36 by the wheel axles 38. The main braces 34 are shorter and of the proper mathematical proportion to the length of each leg so that the cross member that forms the base of a rigid triangle, labeled the stop plate 46, is in an approximate horizontal and level position to the roof of the building and the ground when the unit 10 is in the operational position. The main braces 34 are made stable and rigid by the cross braces 30 which make an "X" between opposite braces 34. Also the pulley cross brace 28 adds strength and rigidity to the device 10. This pulley cross brace 28 also provides for attachment of a ladder pulley 50 should the pulling device or winch 74 be located at its optional ladder 26 attachment point. The pulling device or winch 74 is shown in these figures on the unit 10, which is the preferred embodiment for hand winching or lifting. If the winch 74 was located at the base of the ladder on its rungs 76 on a winch plate 75, the cable 68 would travel through the top pulley 48 and through the ladder pulley 50 and down to the winch 74. In the preferred embodiment that is shown in these figures, the cable 68 travels from the load 70 up through the top pulley 48, supported by the top pulley bracket 78, and to the winch 74 which is located between the main braces 36 on a winch plate 75. The winch 74, in this embodiment, is a brake winch 74, which is easily accessible and operable by a worker from the top of the structure 72 with the device 10 fully rolled out to the edge and lifting a load.

The sheath rod 18 penetrates the main rod pivot 24 at the distal end of the main braces 34. The main A brace 34 has reinforcement at the main reinforcement 35. The adjustable ladder sheath 12 fits over the sheath rod 18 which penetrates it. The sheath 12 fits to the outside of each main brace 34 and is restrained by the rod pin 22 at the rod pinhole 15, which keeps the sheath on the sheath rod 18. This rod pin 22 and rod pin hole 15 can communicate with the pin hole 25 and the rod connector 23 to connect two or more lifts 10 near the top of the ladder 26. Near the top of the lift 10, the multiple connecting brace 40 can communicate with the male top brace 44 also, to connect two or more lifts 10. This connecting brace 40 slips over the top brace 44 and is pinned with the connecting pin 60 through the connecting pin hole 58 and the pin hole 56.

The sheaths 12 may move on the sheath rod 18 to adjust them to any ladder side rail width. The sheaths 12 fit over the ladder side rails 27, loading the weight onto the rails 27. On the sheath 12 is attached the U-bolt bracket 17 with holes in it to accommodate a standard U-bolt 20. The U-bolt 20 may be attached to the bracket 17 and to the rungs 76 of the ladder 26 to provide for permanent attachment of the sheaths 12 and also to prevent accidental disengagement of the unit 10 from the ladder 26. The U-bolt bracket 17 is on the inside of the sheaths 12 and provides for easy attachment with a U-bolt 20 to the rung 76. The main A braces 34 pivot at the main rod pivot 24 through which the sheath rod 18 penetrates. Pivoting may also occur within the sheath 12 where the sheath rod 18 penetrates it, dependent on where the least amount of friction occurs when the unit 10 has a load 70 attached. Pivoting at either point is not undesirable. Pivoting occurs when the lift device 10 is pushed toward the edge of the structure 72 or rolled back onto it, with or without a load 70. The worker never has to lift any of the load 70, telescope legs, or otherwise manipulate the device 10, except to crank the winch 74 and roll the unit 10. The legs or main braces 34 are inside the ladder side rails 27, in this embodiment, and are connected to the sheath rod 18, when the unit is attached.

The main braces 36 go upwardly at an oblique angle and are connected to the male top brace 44. The wheels 66 are on their distal end, along with the wheel brace 62. The main braces 36 are metal channels, in this embodiment. The smooth side faces toward the inside of the unit 10. The cross braces 32 are between the main braces 36. These provide for strength and rigidity of the device 10. Also mounted between the braces 36 is the wheel brace 62 which provides for greater stability, rigidity and strength of the device 10. Also mounted between the main braces 36 is the top winch brace 79, the bottom winch brace 77, the winch plate 75, and the winch 74. These are located above the wheel brace 62 at a point which provides for easy operation when the unit is rolled out or in to the structure 72. The top winch brace 79 and the bottom winch brace 77 fit between and attach to each main brace. These provide a point of attachment for the winch plate 75, onto which the winch 74 is mounted.

The main braces 36 and the main braces 34 terminate at the top of the unit. The braces 36 are both mounted on the male top brace 44, which is a rod of melt that penetrates the female top brace 42, which is a tube of metal, onto which are mounted the main braces 34. This arrangement, a rod 18 within a pipe or tube 42, allows the two sets of legs to be folded or pivoted together when the stop plate 46 is disengaged. The smooth side of the braces 36 is to the inside and the smooth side of the braces 34 is to the outside. The braces 34 and the braces 36 are made of metal channel material. As these members fold or unfold and pivot, there is Just room for the stop plate 46 that sandwiches between the two members next to their smooth sides. The stop plate 46 is a main stress member that is composed of a metal plate strip with threaded holes on each end to receive metal bolts.

As shown in FIG. 1, a single unit 10 has been rolled back onto a structure 72, after lifting a load and is in position to lower the load 70 onto the structure 72. The winch 74 is mounted between the braces 36 on a winch plate 75, attached to a bottom winch brace 77 and a top winch brace 79, each of which are attached to the braces 36. The winch plate 75 is attached between these braces, onto which the winch 74 is attached. The cable 68 from the winch 74 travels through the top pulley 48 which is mounted onto the female top brace 42 via the top pulley bracket 78. The cable 68 then travels down to a load 70 to be lifted, lowered, suspended, or manipulated. The winch 74 is in such a position on the unit 10 so as to be easily and safely operated by a worker on the roof, with the unit 10 in any position. The top caps 82 and the top caps 84 are at the top terminal end of each set of braces 36 and braces 34. These caps add rigidity and strength and resistance to torque to the lift 10. The stop plate bolt head 91 is the end at of the stop plate 46 which penetrates the bolt stop 94. This bolt head 91 is tightened when the unit 10 is made ready for operation. The bolt head 91 is loosened when the unit 10 is ready to be folded for transport or storage. The stop plate bolt is disengaged from the brace 36 and folded down by operation of the swivel bolt 95 that allows the stop plate 46 to swivel.

Figure 8:
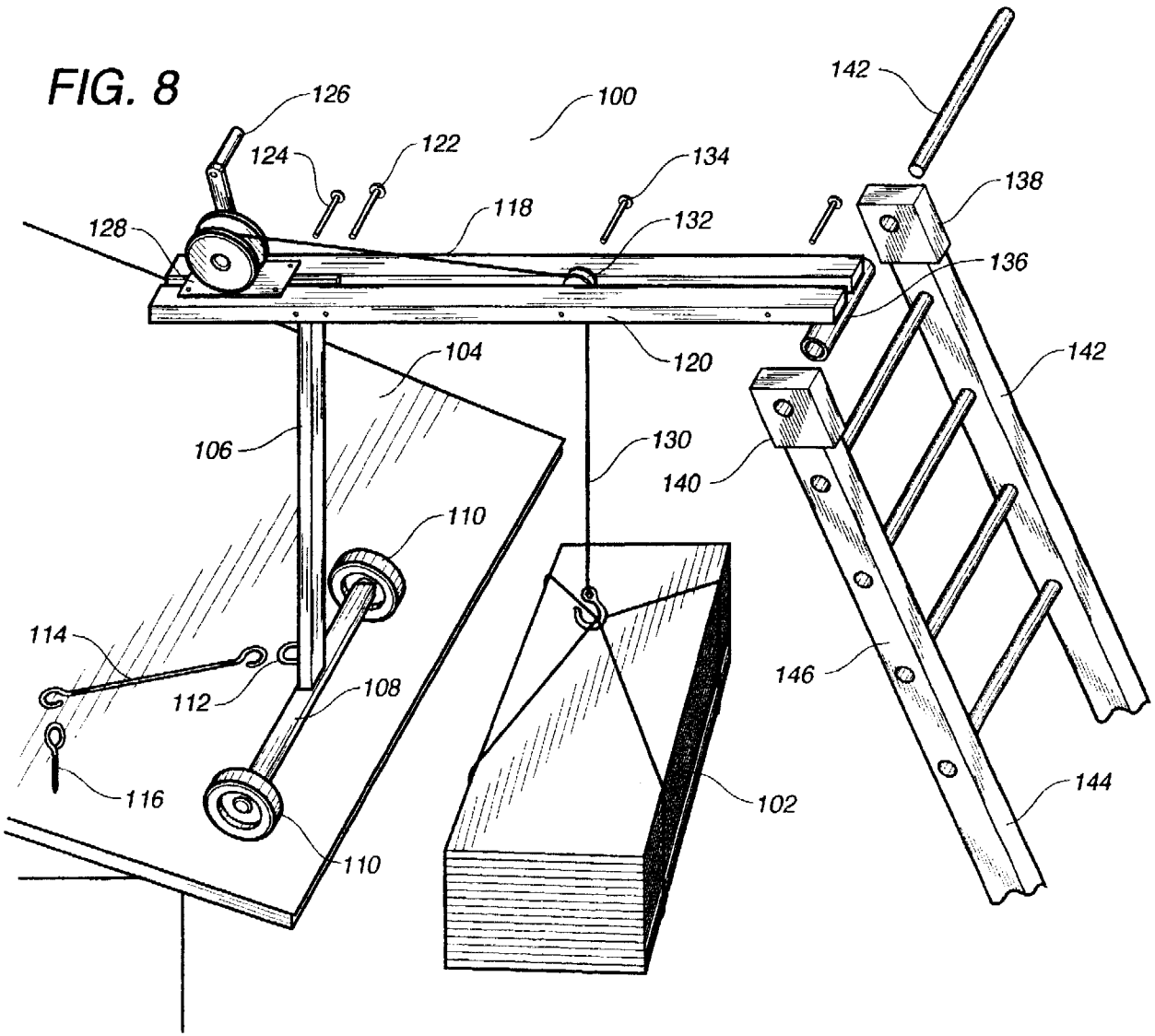
FIG. 8 shows an alternative embodiment of the present invention which is adapted for the lifting of shingles.

FIG. 8 shows an alternative embodiment 100 of the lifting device in accordance with the present invention. The lifting device 100 is specifically configured for the lifting of shingles 102 onto an inclined roof 104. In particular, in FIG. 8, it can be seen that a main brace 106 has one end connected to a wheel support 108. Wheels 110 are connected to opposite ends of the wheel brace 108. An eyelet 112 is connected to a surface of the main brace 106 so as to allow for the receipt of a roof tether strap 414. The roof tether strap is connected to the eyelet 112 and extends rearwardly from the main brace 106. An eye bolt 116 can be threadedly inserted into the inclined roof 104. The roof eye bolt 116 has an eyelet which is suitable for the receipt of the opposite end of the roof tether strap 114. In this manner, the wheels 110 and the brace 108 can be secured in proper relation to the surface of the inclined roof 104.

The brace 106 extends upwardly from the wheel support 108 so as to engage struts 118 and 120. Specifically, the main brace 106 is pinned between each of the struts 118 and 120. Removable pins 122 and 124 can extend through holes in the struts 118 and 120 so as to engage corresponding holes at the end of the main brace 106.

The winch assembly 126 is mounted on a winch bracket 128 onto the top surface of the struts 118 and 120. As such, the winch assembly 126 is in the proper position for the raising and lowering of the shingles 102. A cable 130 extends from the winch assembly 126, over a pulley 132 and downwardly to the shingles 102. A permanent bolt 134 serves to secure the pulley 132 in its position between the struts 118 and 120.

A tubular member 136 is secured to the opposite end of the struts 118 and 120 from the winch assembly 126. The ladder sheaths 138 and 140 are pivotally connected to the tubular member 136 through the insertion of a ladder pin 142. Ladder pin 142 will extend through the holes in the respective ladder sheath 138 and 140 so as to maintain such sheaths in pivotal relationship relative to the struts 118 and 120. The ladder sheath 138 will engage the side rail 142 of ladder 144. Similarly, the ladder sheath 140 will engage the side rail 146 of the ladder 144. In this arrangement, the rotation of the handle of the sheath assembly 126 can easily allow the raising and lowering of the shingles 102 to a desired position on the inclined roof 104. The ladder 144 and the main brace 106 provide the necessary vertical support forces so as to allow for the lifting and lowering of the shingles 102.

The swiveling support device of generally triangular configuration provides a highly reliable, lightweight, strong, yet economical device. It can be used by one person in singular and some multiple applications. When hooked to like lifting devices, it can lift, lower, suspend, or manipulate incredible loads of weight and size to the top or sides of buildings or structures.

Likewise is the unique advantage of a swiveling device which is able to swivel at the connection point of a ladder or the like. It also has a generally triangular shape which is able to lift and suspend nearly 100% of vertical weight when lifting, lowering, suspending, or manipulating loads. Never does a worker have to support any of the vertical weight of a load. No parts of the device need be adjusted or manipulated during operation, other than rolling of the unit and operation of the lifting or pulling apparatus. No parts of a ladder need to be modified. The unit is adjustable to any ladder, quickly and without time consuming procedures.

The present invention provides potential multiple attachment on either side of the device in any number to provide stability and increased lifting capacity.

While the above description contains many specificities, these should not be construed as limitations on the scope of the invention, but rather as an exemplification of one preferred embodiment thereof. Many other variations are possible. For example, this device can be adapted for specialized functions such as setting transformers on power poles. Another example is the adaptation of this device to the top of a fire ladder or fire truck ladder which could bridge to structures to lower, raise, or suspend people or materials for rescue or fire fighting. Another example is the adaptation to inclined roofs to raise and lower shingles or other roofing materials to roofers. Another example is to multiply connect units and suspend a scaffold beside a building or structure for workers to work from. Materials, composition, and arrangement into a generally triangular configuration may be accomplished with many variations. Materials, composition, and arrangement into a generally triangular configuration with a pivoting point at the top of a ladder, also may be accomplished with many variations.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A lifting apparatus comprising:

a frame having a first bracing member and a second bracing member pivotally connected together, said second bracing member having a ladder receptacle means affixed to an end of said second bracing member opposite the pivotal connection with said first bracing member, said ladder receptacle means for receiving an end of a ladder therein, said second bracing member comprising:

a first brace;

a second brace extending in parallel relationship with said first brace; and a cross brace affixed to and extending between said first and second braces;

said ladder receptacle means comprising:

a first ladder sheath pivotally connected to an end of said first brace opposite the pivotal connection of said first bracing member with said second bracing member;

a second ladder sheath pivotally connected to an end of said second brace opposite the pivotal connection of said first bracing member with said second bracing member;

a bracket connected to at least one of said first and second ladder sheaths; and a U-bolt means connected to said bracket, said U-bolt means for extending around a rung of said ladder; and a pulley means affixed to said frame, said pulley means for receiving a cable therein such that a portion of said cable extends vertically downwardly between said first and second bracing members.

2. The lifting apparatus of claim 1, said first bracing member having a movement means affixed to an end of said first bracing member opposite the pivotal connection with said second bracing member, said movement means for allowing an end of said first bracing member to be moved toward and away from said second bracing member.

3. The lifting apparatus of claim 2, said movement means comprising:

a wheel rotatably connected to said end of said first bracing member.

4. The lifting apparatus of claim 1, said first bracing member comprising:

a first brace;

a second brace extending in parallel relationship with said first brace; and a cross brace affixed to said first brace and said second brace and extending therebetween.

5. The lifting apparatus of claim 1, further comprising:

a winch means affixed to said first bracing member; and a cable extending outwardly from said winch and over said pulley means, said winch means for moving said cable over said pulley means.

6. The lifting apparatus of claim 1, said frame further comprising:

a tubular member affixed to an end of said frame adjacent the pivotal connection of said first bracing member with said second bracing member, said pulley means being suspended from said tubular member, said tubular member forming the pivotal connection of said first bracing member with said second bracing member.

7. The lifting apparatus of claim 6, said tubular member extending linearly outwardly of said frame, said tubular member having a connector means at an end outward of said frame, said connector means for detachably receiving a tubular member of another frame.

8. The lifting apparatus of claim 1, further comprising:

a stop plate means connected to said frame at a location below the pivotal connection of said first and second bracing members, said stop plate means for limiting an angle of pivotal movement of said first bracing member with respect to said second bracing member.

9. The lifting apparatus of claim 8, said stop plate means comprising:

a bar having one end connected to one of said first and second bracing members at an opposite end engaging the other of said first and second bracing members.

10. The lifting apparatus of claim 9, said bar forming a triangular configuration with said first bracing member and said second bracing member.

11. The lifting apparatus of claim 1, said pulley means comprising:

a pulley attached to and suspended from said cross brace, said cross brace positioned below the pivotal connection of said first bracing member with said second bracing member.

12. The lifting apparatus of claim 1, each of said first and second ladder sheaths having an interior area having a size suitable for slidably receiving an end of a side rail of the ladder therein.

* * * * *